US006407497B1

(12) United States Patent
Lee et al.

(10) Patent No.: US 6,407,497 B1
(45) Date of Patent: Jun. 18, 2002

(54) COMPOSITION FOR FORMING CONDUCTIVE LAYER AND CATHODE RAY TUBE EMPLOYING CONDUCTIVE LAYER FORMED USING THE SAME

(75) Inventors: Ji-won Lee; Jong-whan Park, both of Suwon; Myun-ki Shim, Seoul; Dong-sik Zang, Suwon, all of (KR)

(73) Assignee: Samsung Display Devices Co., Ltd., Suwon (KR)

( * ) Notice: Subject to any disclaimer, the term of this patent is extended or adjusted under 35 U.S.C. 154(b) by 0 days.

(21) Appl. No.: 09/370,215

(22) Filed: Aug. 9, 1999

(30) Foreign Application Priority Data

Jan. 13, 1999 (KR) ..... 99-714
Jan. 13, 1999 (KR) ..... 99-716

(51) Int. Cl.[7] ..... H01J 31/00

(52) U.S. Cl. ..... 313/480; 313/385; 313/386; 313/493; 252/511

(58) Field of Search ..... 313/480, 385, 313/386, 493; 252/511

(56) References Cited

U.S. PATENT DOCUMENTS 5,523,649 A * 6/1996 Tong et al. ..... 313/479
5,587,835 A * 12/1996 Shimizu et al. ..... 359/589
5,908,585 A * 6/1999 Shibuta ..... 252/506
6,351,063 B1 * 2/2002 Lee et al. ..... 313/479

FOREIGN PATENT DOCUMENTS

KR 94-14738 7/1994
KR 95-11564 5/1995

* cited by examiner

*Primary Examiner*—Vip Patel
*Assistant Examiner*—Kevin Quarterman
(74) *Attorney, Agent, or Firm*—Leydig, Voit & Mayer, Ltd.

(57) ABSTRACT

There are provided a composition for forming a conductive layer comprising 0.01~0.1% by weight of a conductive black pigment, 0.05~10% by weight of a binder,0.01~50% by weight of a conductive agent, and the remaining amount of a solvent on the basis of the total weight of the composition, and a cathode ray tube (CRT) having the conductive layer formed by coating the composition on the outer surface of a panel, drying and heating the same, and a protective layer formed on the conductive layer. The conductive layer formed using the composition has excellent conductivity, contrast characteristics and film properties. Also, a clean color purity and high-quality body color are attained.

18 Claims, 1 Drawing Sheet

FIG. 1 PRIOR ART
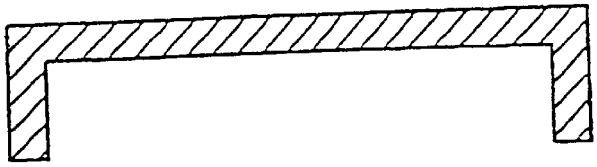
FIG. 2 PRIOR ART
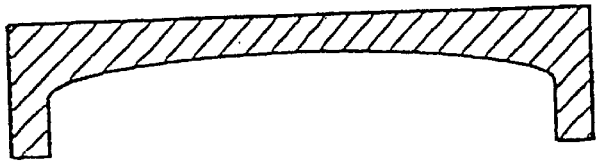
FIG. 3A
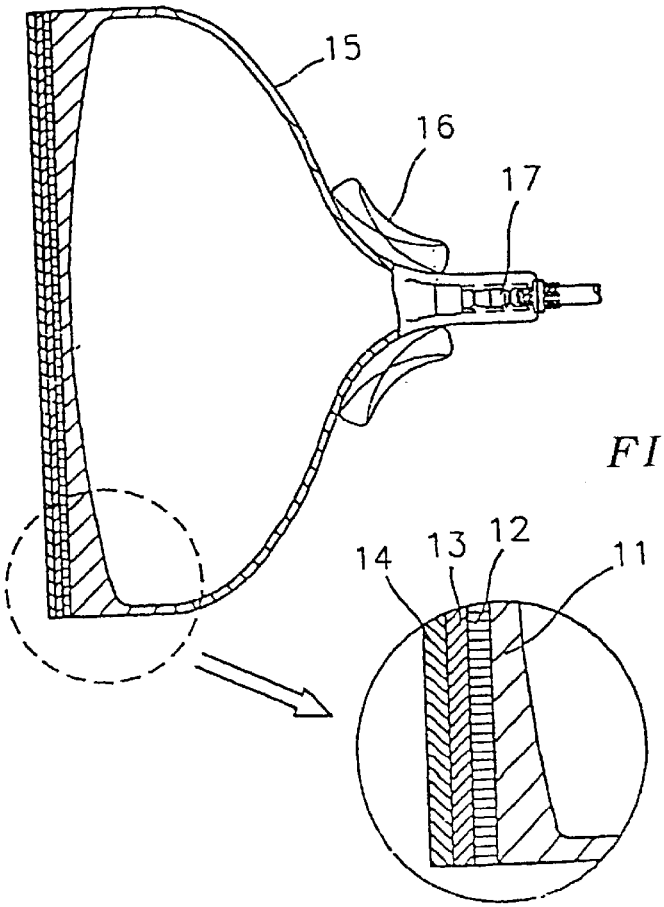
FIG. 3B

COMPOSITION FOR FORMING CONDUCTIVE LAYER AND CATHODE RAY TUBE EMPLOYING CONDUCTIVE LAYER FORMED USING THE SAME

BACKGROUND OF THE INVENTION

1. Field of the Invention

The present invention relates to a composition for forming a conductive layer, and more particularly, to a composition for forming a conductive layer having excellent conductivity and contrast characteristics, and a cathode ray tube (CRT) having the conductive layer formed using the above composition.

2. Description of the Related Art

The driving principle of a CRT lies in that electron beam emitted from an electron gun is selectively deflected by a deflection yoke according to landing positions and lands on a phosphor layer formed on the inner surface of a panel to thus excite the phosphor causing it to luminesce, thereby forming an image.

As the panel for a CRT, a curved panel having a predetermined curvature is typically used. Although the curved panel has a disadvantage in view of attainment of a high-quality image, caused by severe glare and image distortion at the peripheral portion thereof, it is still chiefly used as a panel for a CRT due to a technical difficulty in manufacturing flat panels.

However, according to recent advancement of a technology of manufacturing flat panels, existing curved panels are replaced by flat panels having a curvature close to infinity.

A panel having a large curvature, that is, a nearly flat panel, can realize a clean image by suppressing the blaze due to reflection of external light, reduce eye fatigue and avoid distortion of an image.

As an example of a flat panel, a panel shown in FIG. 1, whose internal and external surfaces are both completely flat, has been proposed. In a CRT employing such a flat panel, an image formed on the central portion of the panel appears to recede inwardly.

To overcome this problem, as shown in FIG. 2, a flat panel having a completely flat external surface and a curved internal surface having a predetermined curvature has been proposed.

However, according to this flat panel, it is difficult to attain a uniform image due to different transmittances between the central portion and the peripheral portion of the panel, which is caused by a difference in thicknesses. Also, in the case of employing a general dark tint panel or a semi-tint panel having a transmittance of about 40~50% as the flat panel, the difference in transmittances between the central portion and the peripheral portion of the panel becomes bigger.

Thus, according to the present invention, there has been proposed a method for overcoming the above-mentioned problems, by which a clear panel having a transmittance of 80% or higher is used as the flat panel, and a conductive layer for adjusting the transmittance and improving contrast characteristics is coated on the external surface thereof.

SUMMARY OF THE INVENTION

To solve the above problems, it is an objective of the present invention to provide a composition for forming a conductive layer having excellent conductivity and contrast characteristics.

It is another objective of the present invention to provide a cathode ray tube employing the conductive layer formed using the composition.

Accordingly, to achieve the first objective, there is provided a composition for forming a conductive layer including 0.01~1.0% by weight of a conductive black pigment, 0.05~10% by weight of a binder, 0.01~50% by weight of a conductive agent, and the remaining amount of a solvent on the basis of the total weight of the composition.

To achieve the second objective, there is provided a cathode ray tube including a panel, and a conductive layer and a protective layer sequentially formed on the outer surface of the panel, wherein the conductive layer is prepared by coating the composition for forming a conductive layer mentioned above on the outer surface of the panel, coating, drying and heating the same.

BRIEF DESCRIPTION OF THE DRAWINGS

The above objectives and advantages of the present invention will become more apparent by describing in detail a preferred embodiment thereof with reference to the attached drawings in which:

FIG. 1 is a sectional view illustrating an example of a general flat panel;

FIG. 2 is a sectional view illustrating another example of a general flat panel; and FIG. 3A is a sectional view illustrating a cathode ray tube employing a flat panel on which a conductive layer according to the present invention is formed.

FIG. 3B is an enlarged sectional view illustrating a cathode ray tube employing a flat panel on which a conductive layer according to the present invention is formed.

DESCRIPTION OF THE PREFERRED EMBODIMENTS

A composition for forming a conductive layer according to the present invention includes 0.01~1.0% by weight of a conductive black pigment, 0.05~10% by weight of a binder, 0.01~50% by weight of a conductive agent, and the remaining amount of a solvent on the basis of the total weight of the composition.

In the composition, the conductive black pigment is at least one selected from the group consisting of carbon black and titanium black, and the average particle diameter thereof is 200 nm or less, and more preferably 120 nm or less.

Also, the binder is at least one selected from a silane coupling agent such as epoxysilane, trimethoxysilane or vinylsilane, metal alkoxide represented by formula (1) and silicon alkoxide oligomer represented by formula (2):

$$[M_1(OR)_m] \qquad \text{Formula (1):}$$

wherein $M_1$ is one selected from the group consisting of Si, Ti, Sn, Zr and Ce, R may be the same as or different from one another and is a $C_1$–$C_4$ alkyl, and m is an integer selected from 4 to 6;

$$(SiO)_n(OR)_{4-2n}, \qquad \text{Formula (2):}$$

wherein n is in the range of 0.5~1.5, R is a $C_1$–$C_4$ alkyl, and the average molecular weight is 400~6,000.

If the average molecular weight of the silicon alkoxide oligomer represented by formula (2) is less than 400, the film hardness decreases. On the other hand, if the average molecular weight of the silicon alkoxide oligomer is greater than 6,000, the viscosity of the composition increases.

Also, the conductive agent is preferably at least one selected from the group consisting of metal, metal oxide and a conductive polymer. Here, the metal and metal oxide are not specifically restricted if it is widely used in the art and has an average particle diameter of 200 nm or less, and more preferably 120 nm or less. In detail, the metal includes silver (Ag), gold (Au), platinum (Pt), copper (Cu), nickel (Ni), palladium (Pd), cobalt (Co), rhodium (Rh), ruthenium (Ru) and tin (Sn), and the metal oxide includes tin oxide, indium oxide, indium tin oxide (ITO), antimony oxide, antimony zinc oxide and antimony tin oxide. Also, the conductive polymer is a polymer having a n resonance structure and is not specifically restricted if it is widely use din the art: Detailed examples of the conductive polymer include polypyrrole, polyacetylene, polyfuran, polyparaphenylene, polyselenophene, polythiophene, polyaniline and the like, and derivatives thereof having side-chain substitutes or functional dopants may also be used.

As the solvent, an alcohol solvent such as methanol, ethanol, isopropyl alcohol or n-butanol, or N-methyl-2-pyrolindone (NMP), dimethylformamide or water can be used solely or in combination.

A pigment for adjusting wavelengths may be added to the composition for forming the conductive layer according to the present invention so as to correct color sensitivity of black pigments, thereby improving color purity of an image or attaining a high-quality body color. Here, the pigment for adjusting wavelengths are preferably organic or inorganic pigments exhibiting excellent transmittance in the range of 400~700 nm and having the average particle diameter of 200 nm or less, more preferably 120 nm or less. The content of the pigment is preferably 0.005~0.3% by weight on the basis of the total weight of the composition for forming the conductive layer.

The pigment for adjusting wavelengths may be added to the composition for forming the conductive layer according to the present invention together with a suitable dispersing agent such as sulfone-group containing compounds. Otherwise, the pigment may be added in the form of a pigment composition containing a pigment for adjusting wavelengths, a suitable dispersing agent and a conductive polymer.

The pigment composition includes 0.3~30% by weight of a wavelength adjusting pigment, 0.24~1.2% by weight of a dispersing agent, 5~50% by weight of a conductive polymer and the remaining amount of solvent, based on the total weight of the pigment composition, and can be prepared by dissolving the wavelength adjusting pigment and the dispersing agent in an organic mixture solvent containing the conductive polymer, mechanically dispersing and then ultrasonic-wave milling the same for 0.5~4 hours.

A cathode ray tube (CRT) according to the present invention includes a panel, and a conductive layer and a protective layer sequentially formed on the outer surface of the panel, wherein the conductive layer is prepared by coating the composition for forming a conductive layer according to the present invention on the outer surface of the panel, coating, drying and heating the same.

In the CRT according to the present invention, the protective layer includes at least one selected from the group consisting of a hydrolysis product of metal alkoxide represented by formula (1) and a hydrolysis product silicon alkoxide oligomer represented by formula (2):

$$[M_1(OR)_m] \qquad \text{Formula (1)}$$

wherein $M_1$ is one selected from the group consisting of Si, Ti, Sn, Zr and Ce, R may be the same as or different from one another and is a $C_1$–$C_4$ alkyl, and m is an integer of 4 through 6;

$$(SiO)_n(OR)_{4-2n} \qquad \text{Formula (2)}$$

wherein n is in the range of 0.5~1.5, R is a $C_1$–$C_4$ alkyl and the average molecular weight thereof is 400~6,000.

Also, the wavelength adjusting pigment or the composition containing the same may be added in forming the protective layer, if not added in forming the conductive layer.

On the protective layer, there may be further formed a spray layer containing at least one selected from the group consisting of a hydrolyte of metal alkoxide represented by formula (1) and a hydrolyte of silicon alkoxide oligomer represented by formula (2), and a hydrolyte of fluoroalkylsilane represented by formula (3) may be further formed on the protective layer:

$$[M_1(OR)_m] \qquad \text{Formula (1)}$$

wherein $M_1$ is selected from the group consisting of Si, Ti, Sn and Zr, R may be the same as or different from one another and is a $C_1$–$C_4$ alkyl, and m is an integer of 4 through 6;

$$(SiO)_n(OR)_{4-2n} \qquad \text{Formula (2)}$$

wherein n is in the range of 0.5~1.5, R is a $C_1$–$C_4$ alkyl, and the average molecular weight thereof is 400~6,000;

$$R_1R_2Si(R_3)_3 \qquad \text{Formula (3)}$$

wherein $R_1$ is a $C_{2-C10}$ fluoroalkyl, $R_2$ is a $C_0$–$C_2$ alkyl, $R_3$ may be the same as or different from one another, and is a $C_1$–$C_5$ alkyl or alkoxy or a halogen.

The spray layer may be optionally employed. In the case where the CRT according to the present invention employs a twofold coating layer structure having the conductive layer and the protective layer are sequentially stacked on the outer surface of the panel, fluoroalkylsilane may be further added to the composition for forming the protective layer to reinforce moisture tolerance, thereby preventing a film separation phenomenon and improving film contamination resistance.

FIG. 3A–B are sectional views of a cathode ray tube (CRT) according to the present invention.

Referring to FIG. 3A–B, the CRT according to the present invention includes a panel 11, a funnel 15, a deflection yoke 16 and an electron gun 17. Here, the panel 11 has a curved inner surface having a predetermined curvature and a flat outer surface on which a conductive layer 12, a protective layer 13 and a spray layer 14 are sequentially formed.

A method for manufacturing the CRT according to a preferred embodiment of the present invention will now be described in detail.

First, a conductive black pigment, a conductive agent and a binder are dissolved in an organic solvent to prepare a black pigment containing solution. Then, a pigment for adjusting wavelengths, a conductive polymer and a dispersing agent selected from sulfone-group containing compounds are mixed, dispersed using a paint shaker and then ultrasonic-wave milled, thereby preparing a pigment composition for adjusting wavelengths. The conductive black pigment composition and the pigment composition for adjusting wavelengths are mixed and then ultrasonic-wave milled to prepare a composition for forming a conductive layer. Here, the conductive black pigment and the pigment for adjusting wavelengths have an average particle diameter of 200 nm or less, preferably 120 nm or less. If the average particle diameter is greater than 200nm, white turbidity occurs at the conductive layer, which undesirably lowers the resolution.

The thus-prepared composition for forming a conductive layer is spin-coated on the outer surface of a clear-tint panel for a 17- or 19-inch CRT, and then dried to form the conductive layer.

Subsequently, at least one compound selected from the group consisting of metal alkoxide represented by formula (1) and a silicon alkoxide oligomer represented by formula (2) and an acid catalyst are stirred to mix the solvent, and the resultant mixture is spin-coated on the conductive layer and then dried to form a protective layer.

Successively, at least one compound selected from metal alkoxide represented by formula (1) and silicon alkoxide oligomer represented by formula (2), and fluoroalkylsilane represented by formula (3) and an acid catalyst are mixed with the solvent with stirring, and the resultant mixture is spray-coated on the protective layer and then dried to form an anti-reflection spray layer having unevenness.

Finally, the resultant structure is heated to complete the CRT having a threefold coating layer on the outer surface of the panel.

In the present invention, each layer can be formed by conventional methods in the art, for example, simple coating methods such as spin coating, spray coating or deposition coating.

As described above, the conductive black pigment contained in the composition for forming the conductive layer improves conductivity and lowers transmittance, thereby improving contrast characteristics, and the binder increase the film hardness and strengthens the coupling force between the conductive layer and the upper and lower layers thereof.

In other words, the conductive layer formed using the composition for forming the conductive layer according to the present invention has low resistance in the range of $10^2$~$10^{10}$ Ω/□, preferably $10^3$~$10^4$ Ω/□, and excellent contrast characteristics and film properties.

Now, embodiments of the present invention will be described in detail but the invention is not limited thereto.

The resistance, transmittance, film hardness and moisture tolerance of the CRT obtained in examples and a comparative example were evaluated as follows and the results were demonstrated in Table 1.

Resistance

Surface resistance of a sample was measured at four spots using a surface resistance measuring machine and the average value of the four measured resistance values was calculated.

Transmittance

The transmittance was measured at 550 nm using a spectroscope for visible-ray bands.

Contrast

The contrast was measured using a light source of 400 Lux.

Moisture Tolerance

A panel without a coating layer on its outer surface was prepared as a control sample, and samples for examples and a comparative example and the control sample were impregnated in water of 60° C. for 8 hours. Then, film states and changes in resistance before and after forming the coating layer were observed and the results were demonstrated as follows:

330very good

○: good

Δ: fair x: poor

Example 1

10 g of carbon black dispersing solution (content of carbon black: 0.5 g) obtained by dispersing carbon black having an average particle diameter of 200 nm in water, 10 g of polythiophene and 2 g of tetraethoxysilane dissolved in a solvent mixture composed of 35 g of methanol, 20 g of ethanol, 15 g of isopropylalcohol and 20 g of methylcellosolve were mixed to prepare a carbon black containing composition. Subsequently, a wavelength adjusting pigment composition composed of 10 g of 1.5% blue pigment dispersing solution and 5 g of 2.0% violet pigment dispersing solution was mixed with the carbon black containing composition and then ultrasonic-wave milled for 4 hours to prepare a composition for forming a conductive layer.

Then, the prepared composition was spin-coated on the outer surface of a clear-tint panel for a 19-inch CRT, having about 81% of the average transmittance between central and peripheral portions of the CRT, and dried to form the conductive layer.

Next, 3 g of tetraethoxysilane was mixed with a mixture solvent composed of 30 g of methanol, 50 g of ethanol, 12 g of normal butanol and 4 g of water, 0.5 g of nitric acid was added thereto and reacted at room temperature for 24 hours to prepare a composition for forming a protective layer. Then, the prepared composition was spin-coated on the conductive layer and dried to form the protective layer.

Successively, 3 g of tetraethoxysilane and 0.3 g of $CF_3(CF_2)_7CH_2CH_2Si(OCH_3)_3$ were mixed with a mixture solvent composed of 30 g of methanol, 50 g of ethanol, 12 g of normal butanol and 4 g of water, 0.5 g of nitric acid was added thereto and reacted at room temperature for 24 hours to prepare a composition for forming a spray layer. Then, the prepared composition was spray-coated on the protective layer and dried to form the spray layer.

Finally, the resultant was thermally treated at 200° C. for 30 minutes, thereby completing the CRT, and the resistance, transmittance, contrast and moisture tolerance thereof were measured and demonstrated in the following Table 1.

Example 2

With the exception of a spray layer not being formed on the protective layer, this embodiment was carried out in the same manner as described in Example 1.

Example 3

With the exception of 0.3 g of $CF_3(CF_2)_7CH_2CH_2Si(OCH_3)_3$ being further added in preparing the composition for forming a protective layer and a spray layer not being formed, this embodiment was carried out in the same manner as described in Example 2, to complete a CRT.

Example 4

With the exception of a wavelength adjusting pigment composition composed of 23.7 g of 1.5% blue pigment dispersing solution and 7.9 g of 2.0% violet pigment dispersing solution being further added in preparing the composition for forming a protective layer, rather than in preparing the composition a conductive layer, this embodiment was carried out in the same manner as described in Example 1, to complete a CRT.

Example 5

With the exception of the composition for forming a conductive layer being prepared using 3 g of indium tin oxide (ITO) having an average particle diameter of 200 nm instead of polythiophene, this embodiment was carried out in the same manner as described in Example 1, to complete a CRT.

Example 6

With the exception of a composition for forming a conductive layer being prepared using 0.3 g of silver (Ag) having an average particle diameter of 120 nm instead of polythiophene, this embodiment was carried out in the same manner as described in Example 1, to complete a CRT.

Comparative Example

With the exception of tetraethoxysilane not being added in preparing a composition for forming a conductive layer and a spray layer not being formed, this embodiment was carried out in the same manner as described in Example 1, to complete a CRT.

TABLE 1

| | Resistance (Ω/□) | Transmittance (%) | Contrast | Moisture tolerance |
|---|---|---|---|---|
| Example 1 | $8 \times 10^3$ | 60 | 41 | ◎ |
| Example 2 | $3 \times 10^4$ | 61 | 40.3 | ○ |
| Example 3 | $4 \times 10^4$ | 62 | 42.1 | ◎ |
| Example 4 | $4.5 \times 10^4$ | 61 | 40.3 | ◎ |
| Example 5 | $6 \times 10^4$ | 65 | 31.6 | ◎ |
| Example 6 | $8 \times 10^2$ | 50 | 45.5 | ◎ |
| Comparative Example | $5 \times 10^8$ | 56 | 43.1 | x |

It is understood from Table 1 that the CRT according to the present invention has excellent conductivity and contrast characteristics and moisture tolerance thereof is also improved.

In Example 2, since the spray layer containing a hydrolyte of fluoroalkylsilane, which is a water-repellent component, is not formed, moisture tolerance decreased a little. However, due to the siliconalkoxide oligomer added to the conductive layer as a binder, the moisture tolerance was still maintained at a predetermined level.

Although the transmittance is low and the contrast characteristics are excellent, in the comparative example, the resistance is high and the moisture tolerance is poor. Thus, the film stability is considerably impaired.

The conductive layer formed using the composition according to the present invention exhibits excellent transmittance and contrast characteristics. Also, the conductive layer has excellent moisture tolerance, which improves the film stability, and provides clean color purity and high-quality body color.

What is claimed is:

1. A composition for forming a conductive layer comprising:

0.01–1.0% by weight of a conductive black pigment;

0.05–10% by weight of a binder;

0.01–50% by weight of a conductive agent;

0.017–60% by weight of a wavelength adjusting pigment composition; and the remaining amount of a solvent, on the basis of the total weight of composition, wherein the wavelength adjusting pigment composition comprises 0.3–30% by weight of a wavelength adjusting pigment having a maximum transmittance in the wavelength range of 400–700 nm and an average particle diameter of 200 nm or less, and 0.24–1.2% by weight of dispersing agent are dispersed in an organic mixture solvent containing 5–50% by weight of a conductive polymer, on the basis of the total weight of the pigment composition.

2. The composition according to claim 1, wherein the conductive black pigment is at least one selected from the group consisting of carbon black and titanium black, and the average particle diameter thereof is 200 nm or less.

3. The composition according to claim 1, wherein the binder is at least one selected from the group consisting of a silane coupling agent, metal alkoxide represented by formula (1) and silicon alkoxide oligomer represented by formula (2):

$$[M_1(OR)_m] \qquad \text{Formula (1)}$$

wherein $M_1$ is one selected from the group consisting of Si, Ti, Sn, Zr and Ce, R may be the same as or different from one another and is a $C_1$–$C_4$ alkyl, and m is an integer of 4 through 6;

$$(SiO)_n(OR)_{4-2n} \qquad \text{Formula (2)}$$

wherein n is in the range of 0.5~1.5, R is a $C_1$–$C_4$ alkyl and the average molecular weight thereof is 400~6,000.

4. The composition according to claim 1, wherein the conductive polymer is at least one selected from the group consisting of polythiophene, polyaniline, polypyrrole, polyacetylene, polyfuran, polyparaphenylene and polyselenophene.

5. The composition according to claim 1 wherein the conductive black pigment is carbon black.

6. The composition according to claim 1, wherein the conductive agent is at least one selected from the group consisting of metal, metal oxide and a conductive polymer.

7. The composition according to claim 6, wherein the conductive polymer is at least one selected from the group consisting of polythiophene, polyaniline, polypyrrole, polyacetylene, polyfuran, polyparaphenylene and polyselenophene.

8. A cathode ray tube comprising:

a panel; and a conductive layer and a protective layer sequentially formed on the outer surface of the panel, wherein the conductive layer is prepared by coating a composition for forming a conductive layer comprising 0.01–1.0% by weight of a conductive black pigment, 0.5–10% by weight of a binder, 0.01–50% by weight of a conductive agent, and the remaining amount of a solvent on the basis of the total weight of the composition, on the outer surface of the panel, coating, drying and heating the same, wherein the protective layer includes at least one wavelength adjusting pigment having a maximum transmittance in the wavelength range of 400–700 nm and the average particle diameter thereof is 200 nm or less, and the wavelength adjusting pigment is added to a composition suitable for forming a protective layer in the form of a pigment composition containing the wavelength adjusting pigment, a dispersing agent and a conductive polymer, and the pigment composition is prepared by dissolving 0.3–30% by weight of the wavelength adjusting pigment and 0.24–1.2% by weight of the dispersing agent in an organic mixture solvent containing 5–50% by weight of the conductive polymer, mechanically dispersing, and ultrasonic-wave milling the same.

9. The cathode ray tube according to claim 8, wherein the conductive polymer is at least one selected from the group consisting of polythiophene, polyaniline, polypyrrole, polyacetylene, polyfuran, polyparaphenylene and polyselenophene.

10. The cathode ray tube according to claim 8, further comprising a spray layer containing at least one hydrolyte selected from the group consisting of a hydrolyte of metal alkoxide represented by formula (1) and a hydrolyte of silicon alkoxide oligomer represented by formula (2), and a hydrolyte of fluoroalkylsilane represented by formula (3) may be further formed on the protective layer:

$$[M_1(OR)_m] \qquad \text{Formula (1)}$$

wherein $M_1$ is selected from the group consisting of Si, Ti, Sn, Zr and Ce, R may be the same as or different from one another and is a $C_1$–$C_4$ alkyl, and m is an integer of 4 through 6;

$$(SiO)_n(OR)_{4-2n} \qquad \text{Formula (2)}$$

wherein n is in the range of 0.5~1.5, R is a $C_1$–$C_4$ alkyl, and the average molecular weight thereof is 400~6,000;

$$R_1R_2Si(R_3)_3 \qquad \text{Formula (3)}$$

wherein $R_1$ is a $C_2$–$C_{10}$ fluoroalkyl, $R_2$ is a $C_0$–$C_2$ alkyl, $R_3$ may be the same as or different from one another, and is a $C_1$–$C_5$ alkyl or alkoxy or a halogen.

11. The cathode ray tube according to claim 8, wherein the protective layer includes at least one selected from the group consisting of a hydrolysis product of metal alkoxide represented by formula (1) and a hydrolysis product silicon alkoxide oligomer represented by formula (2):

$$[M_1(OR)_m] \qquad \text{Formula (1)}$$

wherein $M_1$ is one selected from the group consisting of Si, Ti, Sn, Zr and Ce, R may be the same as or different from one another and is a $C_1$–$C_4$ alkyl, and m is an integer of 4 through 6;

$$(SiO)_n(OR)_{4-2n} \qquad \text{Formula (2)}$$

wherein n is in the range of 0.5~1.5, R is a $C_1$–$C_4$ alkyl and the average molecular weight thereof is 400~6,000.

12. The cathode ray tube according to claim 7, wherein the protective layer further includes a hydrolyte of fluoroalkylsilane represented by formula (3):

$$R_1R_2Si(R_3)_3 \qquad \text{Formula (3)}$$

wherein $R_1$ is a $C_2$–$C_{10}$ fluoroalkyl, $R_2$ is a $C_0$–$C_2$ alkyl, $R_3$ may be the same as or different from one another, and is a $C_1$–$C_5$ alkyl or alkoxy or a halogen.

13. A cathode ray tube comprising:

a panel; and a conductive layer and a protective layer sequentially formed on the outer surface of the panel, wherein the conductive layer is prepared by coating the composition for forming a conductive layer according to claim 2 on the outer surface of the panel, coating, drying and heating the same.

14. A cathode ray tube comprising:

a panel; and a conductive layer and a protective layer sequentially formed on the outer surface of the panel, wherein the conductive layer is prepared by coating the composition for forming a conductive layer according to claim 3 on the outer surface of the panel, coating, drying and heating the same.

15. A cathode ray tube comprising:

a panel; and a conductive layer and a protective layer sequentially formed on the outer surface of the panel, wherein the conductive layer is prepared by coating the composition for forming a conductive layer according to claim 6, on the outer surface of the panel, coating, drying and heating the same.

16. A cathode ray tube comprising:

a panel; and a conductive layer and a protective layer sequentially formed on the outer surface of the panel, wherein the conductive layer is prepared by coating the composition for forming a conductive layer according to claim on the outer surface of the panel, coating, drying and heating the same.

17. A cathode ray tube comprising:

a panel; and a conductive layer and a protective layer sequentially formed on the outer surface of the panel, wherein the conductive layer is prepared by coating the composition for forming a conductive layer according to claim 4, on the outer surface of the panel, coating, drying and heating the same.

18. A cathode ray tube comprising:

a panel; and a conductive layer and a protective layer sequentially formed on the outer surface of the panel, wherein the conductive layer is prepared by coating the composition for forming a conductive layer according to claim 5, on the outer surface of the panel, coating, drying and heating the same.

* * * * *